US008833268B2

(12) United States Patent
Shirvinski et al.

(10) Patent No.: US 8,833,268 B2
(45) Date of Patent: Sep. 16, 2014

(54) RAILROAD TANK CAR

(75) Inventors: James Shirvinski, Woodworth, LA (US); Jeremy DeLacerda, Elmer, LA (US)

(73) Assignee: UTLX Manufacturing LLC, Alexandria, VA (US)

( * ) Notice: Subject to any disclaimer, the term of this patent is extended or adjusted under 35 U.S.C. 154(b) by 167 days.

(21) Appl. No.: 12/966,335

(22) Filed: Dec. 13, 2010

(65) Prior Publication Data

US 2011/0139032 A1 Jun. 16, 2011

Related U.S. Application Data

(60) Provisional application No. 61/285,644, filed on Dec. 11, 2009.

(51) Int. Cl.
*B61D 5/00* (2006.01)
*B61D 15/06* (2006.01)

(52) U.S. Cl.
CPC . *B61D 5/00* (2013.01); *B61D 15/06* (2013.01)
USPC ..... 105/360; 105/236; 105/358

(58) Field of Classification Search
USPC ..... 105/236, 358, 360, 392.5, 394, 404; 280/832, 838, 839
See application file for complete search history.

(56) References Cited

U.S. PATENT DOCUMENTS 951,239 A 3/1910 Garrett
1,908,684 A 4/1930 Buchanan
2,714,516 A * 8/1955 Brown ..... 280/832
3,100,458 A 8/1963 Baker et al.
3,158,383 A 11/1964 Anderson et al.
3,338,185 A 8/1967 Phillips
3,547,047 A 12/1970 Needham
3,876,739 A 4/1975 Loveland
4,474,632 A 10/1984 Spees
5,042,395 A 8/1991 Wackerle et al.
5,802,984 A 9/1998 Thoman et al.
5,855,174 A 1/1999 Thoman et al.
5,857,414 A 1/1999 Thoman et al.
5,890,435 A 4/1999 Thoman et al.
5,988,074 A 11/1999 Thoman
6,092,472 A 7/2000 Thoman et al.
6,138,580 A 10/2000 Thoman
6,575,102 B2 6/2003 Norton et al.
6,615,741 B2 9/2003 Fecko et al.

(Continued)

FOREIGN PATENT DOCUMENTS

CN 2712749 Y 7/2005
CN 201283867 Y 8/2009

(Continued)

*Primary Examiner* — Zachary Kuhfuss
(74) *Attorney, Agent, or Firm* — DLA Piper LLP (US); R. Blake Johnston

(57) ABSTRACT

Railroad tank cars are provided that include an inner tank, an outer tank, and tank to tank clearance between the inner tank and the outer tank. Insulation and spacers can be located within the tank to tank clearance. The inner tank can shift within the outer tank, and spacers can crush, under significant force loading, such as impact forces generated during a collision or derailment. The inner tank, insulation, spacers, and outer tank thus form an energy absorbing system that reduces the likelihood that the inner tank will be breached, and that a hazardous material contained therein will be released, under such conditions.

15 Claims, 9 Drawing Sheets

(56) References Cited

U.S. PATENT DOCUMENTS

| | | | | |
|---|---|---|---|---|
| 6,892,433 | B2 | 5/2005 | Barry et al. | |
| 7,228,805 | B2 | 6/2007 | Beers et al. | |
| 7,305,923 | B2 | 12/2007 | Creighton et al. | |
| 2002/0195019 | A1* | 12/2002 | Woodall | 105/358 |
| 2004/0089194 | A1 | 5/2004 | Homes | |
| 2010/0307373 | A1* | 12/2010 | Kinsella et al. | 105/358 |

FOREIGN PATENT DOCUMENTS

| | | | |
|---|---|---|---|
| EP | 0768225 | A1 | 4/1997 |
| EP | 0839101 | A1 | 5/1998 |
| EP | 1690770 | A1 | 8/2006 |
| EP | 1 925 524 | | 5/2008 |
| KR | 20080070973 | | 8/2008 |
| MX | PA05005965 | A | 8/2006 |
| SU | 1068313 | A | 1/1984 |
| WO | WO 00/44601 | | 8/2000 |

* cited by examiner

RAILROAD TANK CAR

CROSS-REFERENCE TO RELATED APPLICATIONS

This application claims the benefit of U.S. Provisional Application Ser. No. 61/285,644, filed on Dec. 11, 2009, currently pending.

BACKGROUND

Railroad tank cars are designed to transport liquid commodities, gaseous commodities, and commodities that are gas-liquid mixtures. The interior of a tank car is sometimes lined with a material to isolate the structural components of the tank car from the commodity being transported. Tank cars can be insulated or non-insulated, pressurized or non-pressurized, and can be designed for single or multiple loads. Non-pressurized cars have plumbing at the bottom for unloading, and may have an access port and a dome housing with various valving on the top. Pressurized cars can have a pressure plate, valving, and a protective cylindrical dome housing at the top through which loading and unloading can be accomplished.

Various designs of tank cars have been developed for the transportation of specific types of commodities, including for example, foodstuffs and other materials, including hazardous materials that can pose a threat to safety and health if they are spilled. Traditionally, railroad tank cars have been engineered to contain their commodity based on the commodity's physical and chemical properties, and the inherent stresses placed upon the tank car due to those properties. However, in instances of collision and derailment, a tank car can be subjected to additional forces. In recent years, work has been done towards developing standards and criteria for strengthening railroad tank cars to reduce the risk of spills and increase public safety should a train accident occur.

In response to safety concerns, trends in tank car design have resulted in tank cars that are constructed of thicker steels than what would be required based solely upon the structural loading of specific commodities. Current tank cars thus have steel thickness in excess of what is required to retain the commodity pressure and sustain structural loads, and the additional thickness improves the puncture resistance and crashworthiness of the tank car so that the tank car can be less prone to damage. However, the amount of benefit derived from adding thickness to the outer structure of a tank car is limited, and may not suffice to meet desired criteria for avoiding the release of hazardous materials during events such as collisions or derailment.

BRIEF SUMMARY

The present technology relates to railroad tank cars that contain a commodity according to its physical and chemical properties, and also provides increased levels of puncture resistance and energy absorption to resist release of the commodity in the event of a collision or derailment. In particular, tank cars of the present technology have an outer tank, and an inner tank within the outer tank.

The inner tank is supported by a bottom support structure, where there is a tank to tank clearance defined between the inner tank and the outer tank. Spacers and insulation are located within the tank to tank clearance defined between the inner tank and the outer tank. The inner tank can shift within the outer tank under impact loading conditions and the insulation and spacers absorb energy of the impact loading conditions.

BRIEF DESCRIPTION OF SEVERAL VIEWS OF THE DRAWINGS

Specific examples have been chosen for purposes of illustration and description, and are shown in the accompanying drawings, forming a part of the specification.

DETAILED DESCRIPTION

Tank cars of the present technology are designed to have improved impact resistance as compared to conventional tank cars. The tank cars have an outer tank that surrounds an inner tank. The inner tank is enclosed by the outer tank, and is supported within the outer tank.

Tank cars of the present technology can be used to transport commodities, including but not limited to liquid commodities, gaseous commodities, and commodities that are gas-liquid mixtures. The transported commodities can be hazardous or non-hazardous, and can be pressurized or not pressurized.

Figure 1:
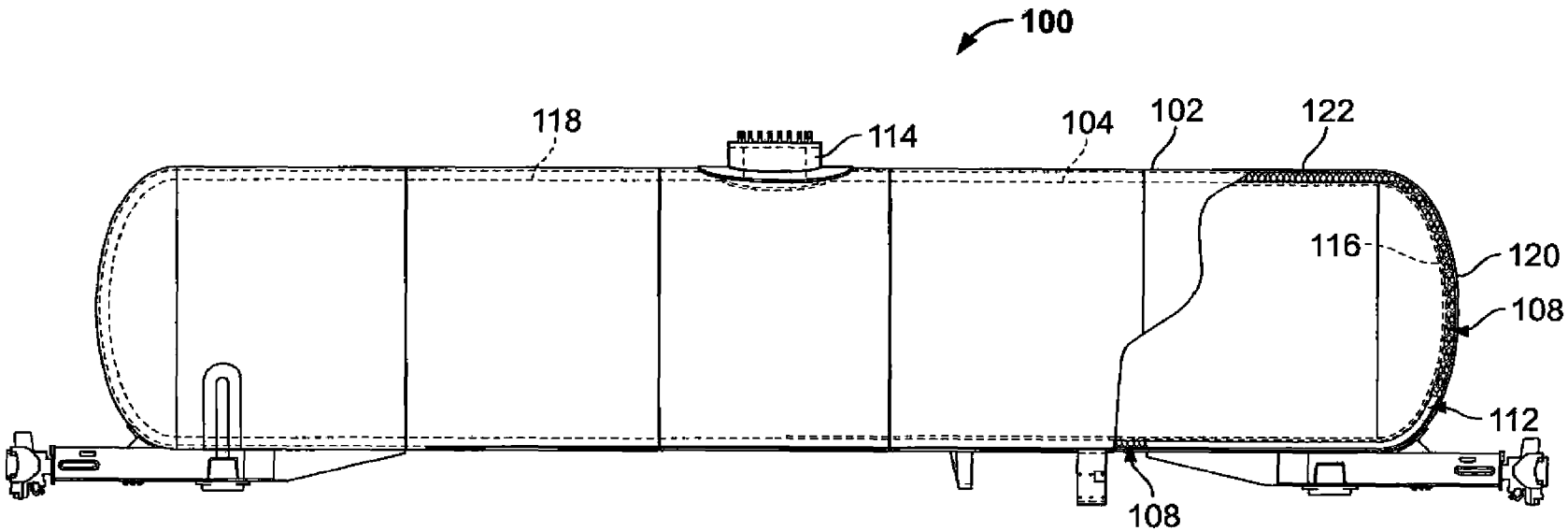
FIG. 1 illustrates a side cross sectional view of one example of a tank car of the present technology.
Figure 2:
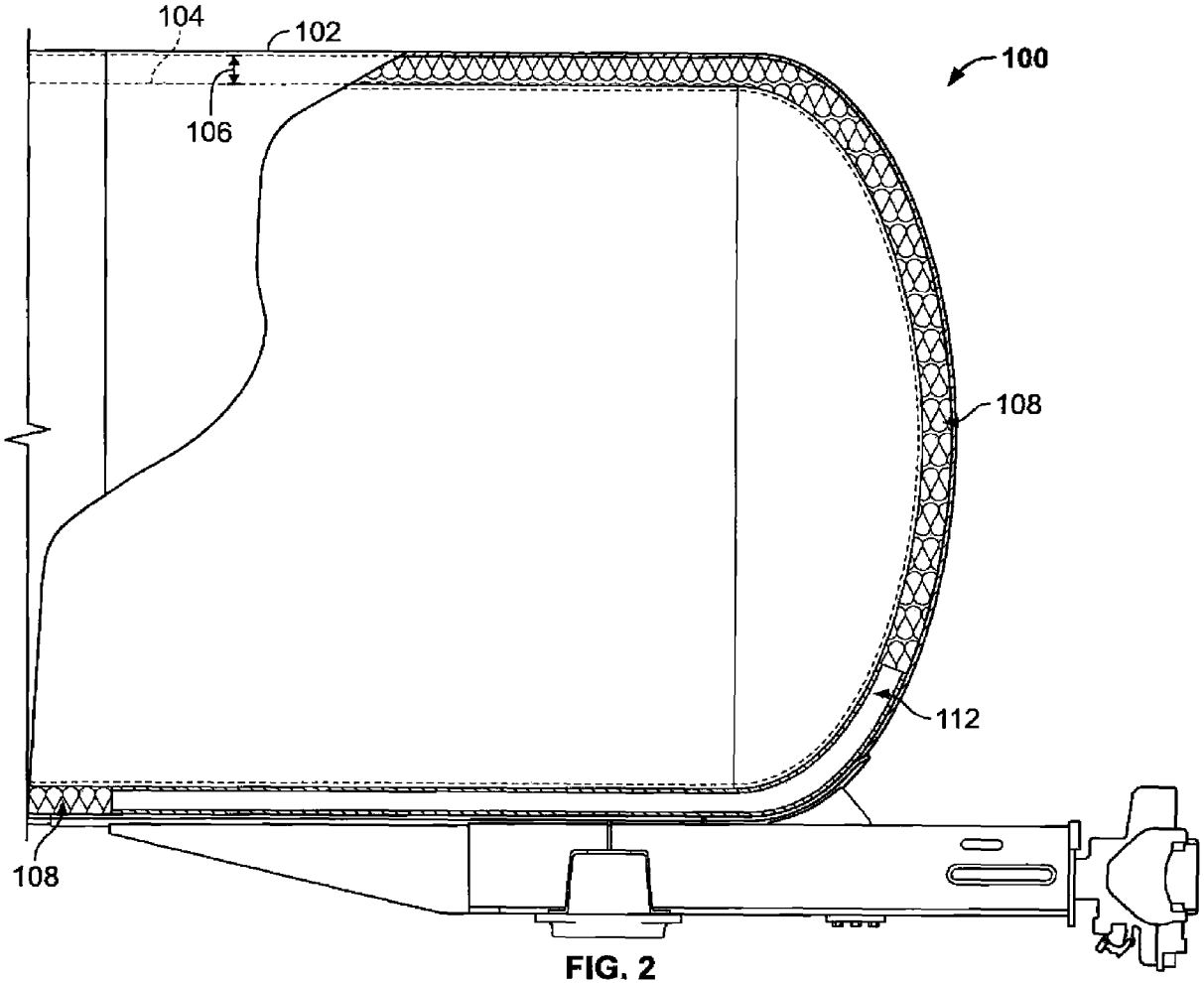
FIG. 2 illustrates a detail view of the cross sectional view of the tank car of FIG. 1.
Figure 3:
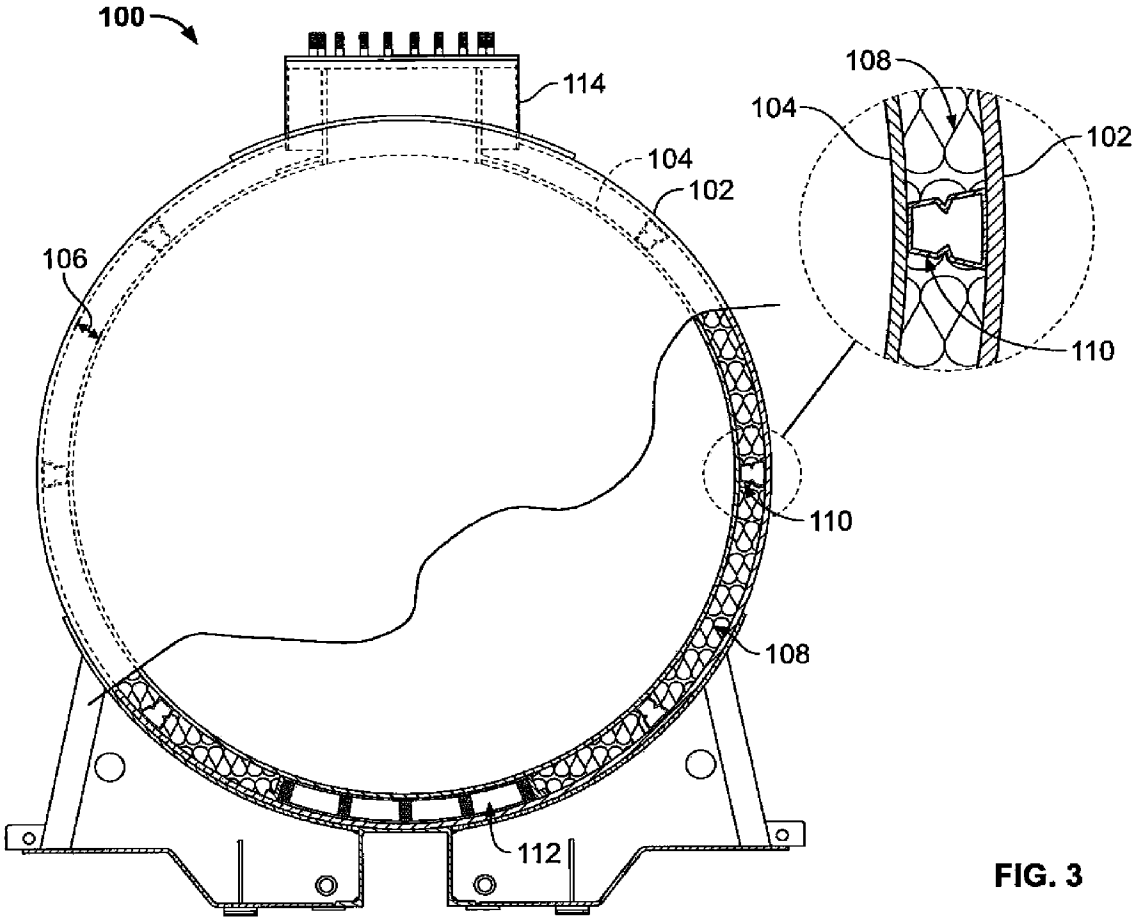
FIG. 3 illustrates an end cross sectional view of the tank car of FIG. 1.

FIGS. 1 through 4 illustrate one example of a tank car 100 of the present technology, which includes an outer tank 102, an inner tank 104, and a tank to tank clearance 106 between the outer tank 102 and the inner tank 104 that contains insulation 108 and spacers 110. The outer tank 104 and the inner tank 102 can each be generally cylindrical, having substantially circular cross-sections that are preferably concentric, as shown in FIG. 3. As illustrated further in FIG. 3, the tank car 100 also includes a bottom support structure 112 that serves to support the inner tank as well as maintains the inner tank's independence from the outer tank. The tank car can also include a dome 114, which can be located at the top of the tank car to provide access for loading and unloading a commodity stored within the inner tank 104 of the tank car 100. In at least one example, the inner tank 104 is rigidly connected to the outer tank 104 only at the dome 114.

The inner tank 104 can be made of any suitable material or materials, and includes an inner tank heads 116 and an inner tank shell 118. In one embodiment, the inner tank heads 116 and the inner tank shell 118 are both made from TC 128 Gr B steel. The thickness of the inner tank heads 116 can be from about ¾ of an inch to about 1 inch. The thickness of the inner tank shell 118 can be from about 7/16 of an inch to about 9/16 of an inch, and preferably has a thickness that is at least about 15/32 of an inch.

The outer tank 102 can also be made of any suitable material, and includes outer tank heads 120 and an outer tank shell 122. In one embodiment, the outer tank head 120 and the outer tank shell 122 can both be made from TC 128 Gr B steel. The thickness of the outer tank head 120 can be at least about ½ an inch, and can preferably be from about ¾ of an inch to about 1 inch. The thickness of the outer tank shell 122 can be at least about 15/32 of an inch, and can preferably be from about ¾ of an inch to about 1 inch.

In one embodiment, the outer tank 102 may be constructed from a special high toughness steel. The high toughness steel is produced by continuous casting from a melt produced in either basic oxygen or electric furnaces. The steel may either be hot rolled with a maximum finishing temperature of 1125° C. or normalized after rolling in order to achieve optimal toughness properties. If normalized, the temperature for the normalization treatment is 950° C. for 1 hour and air cooled. The composition of the steel is: 0.05% C, 0.94% Mn, 0.52% Si, 1.29% Cu, 0.74% Ni, 0.07% Nb, 0.08% Ti, 0.005% S maximum, 0.005% P maximum, remainder Fe. This composition is nominal and may be adjusted for manufacturing and physical property optimization.

In some embodiments, the inner tank shell 118 and the outer tank shell 122 have a combined thickness of at least about 1.5 inches, and the inner tank head 116 and the outer tank head 120 have a combined thickness of at least about 1.7 inches.

The tank to tank clearance 106, which is measured from the outside surface of inner tank shell 118 to the inside surface of the outer tank shell 122, can be any suitable distance. In at least one example, the tank to tank clearance 106 is about 4 inches. As another example only, the clearance could be in the range of approximately 2 to 5 inches.

Spacers 110 are placed between the inner tank 104 and outer tank 102, and can allow for energy absorption. The spacers 110 can be designed to crush under impact loading conditions of significant force loading, such as when the tank car experiences an impact or derailment. The spacers can be made from any suitable material, including, but not limited to, A516-70 or TC128 Gr B steel.

Figure 4:
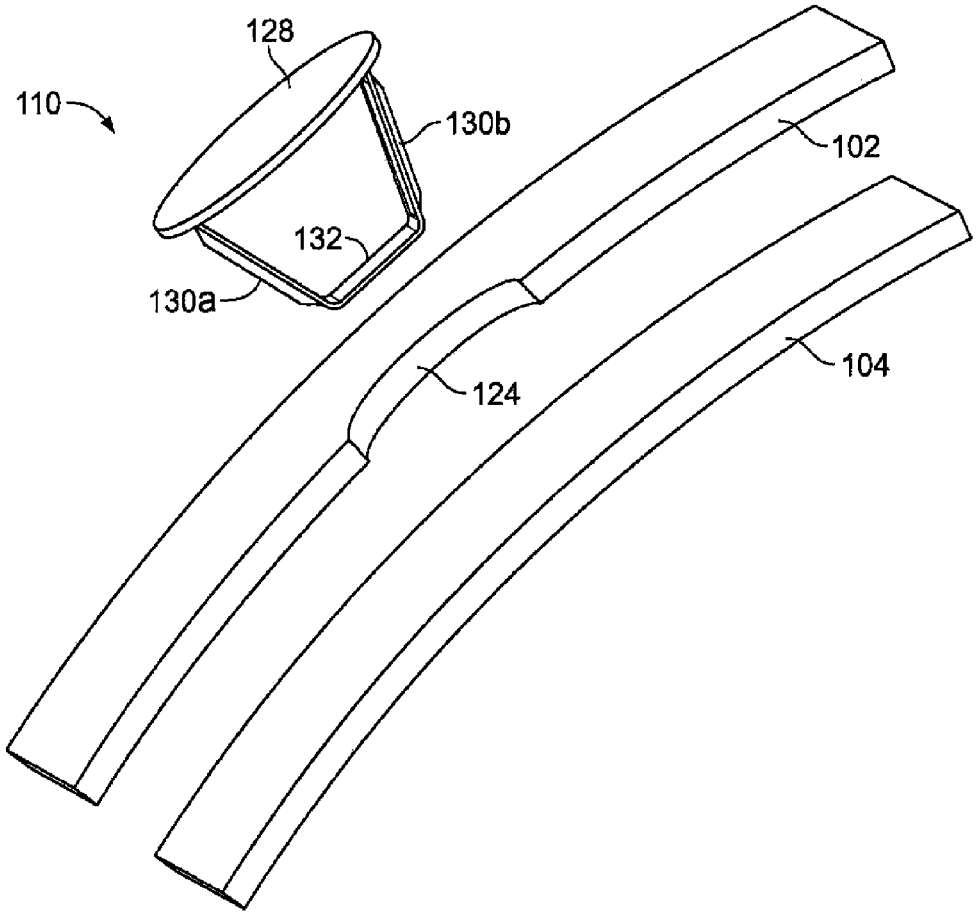
FIG. 4 illustrates one embodiment of a spacer for use in the tank car of FIG. 1.

One example of a spacer is indicated in general at 110 in FIG. 4. In this example, the outer tank 102 includes one or more openings 124, and the spacer 110 extends through each opening 124 to abut the inner tank 104. The spacer 110 has a cover plate 128, at least two legs 130*a* and 130*b* that extend away from the cover plate 128, and a bottom 132 connected to the legs 130*a* and 130*b* that contacts the inner tank shell 104 when the spacer 110 is inserted into the opening 124. In such an embodiment, under impact conditions, the spacers 110 can crumple or crush as the inner tank 104 shifts within the outer tank 102, or the spacers can be dislodged and pushed outwardly by the inner tank 104 shifting within the outer tank 102.

Figure 5:
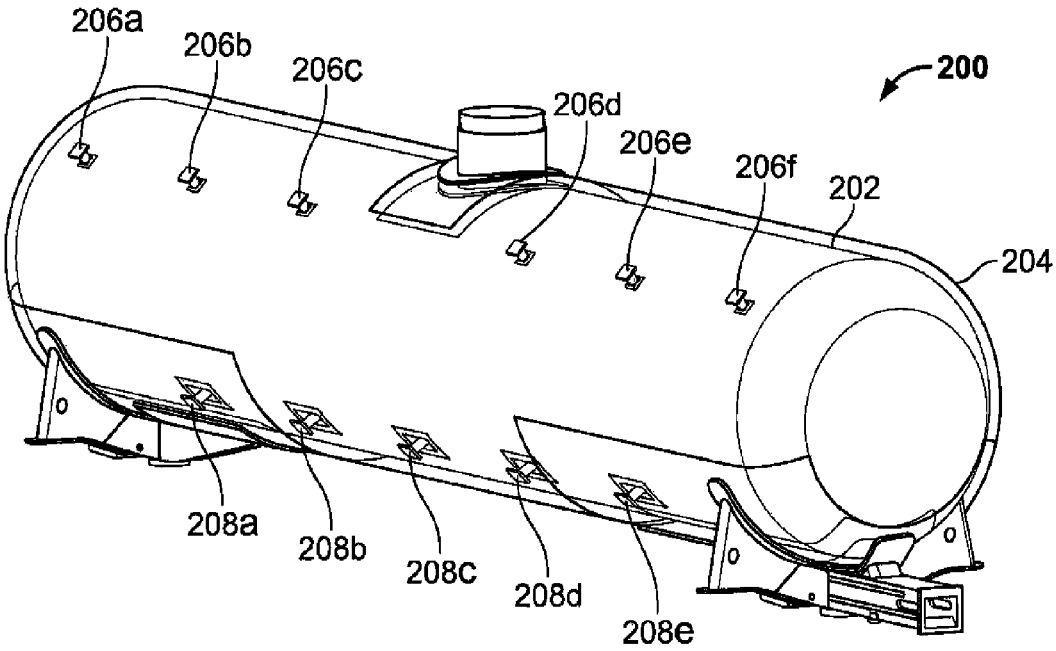
FIG. 5 illustrates a perspective view of a second example of a tank car of the present technology.
Figure 6:
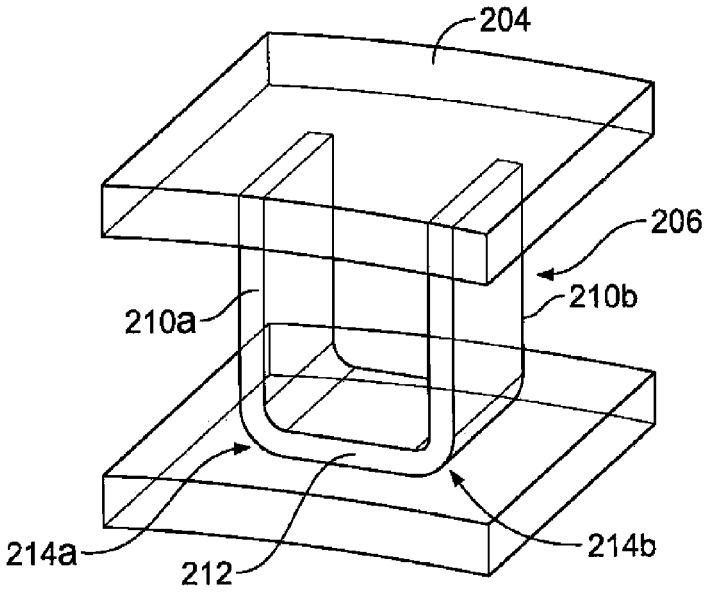
FIG. 6 illustrates an upper spacer of the tank car of FIG. 5.
Figure 7:
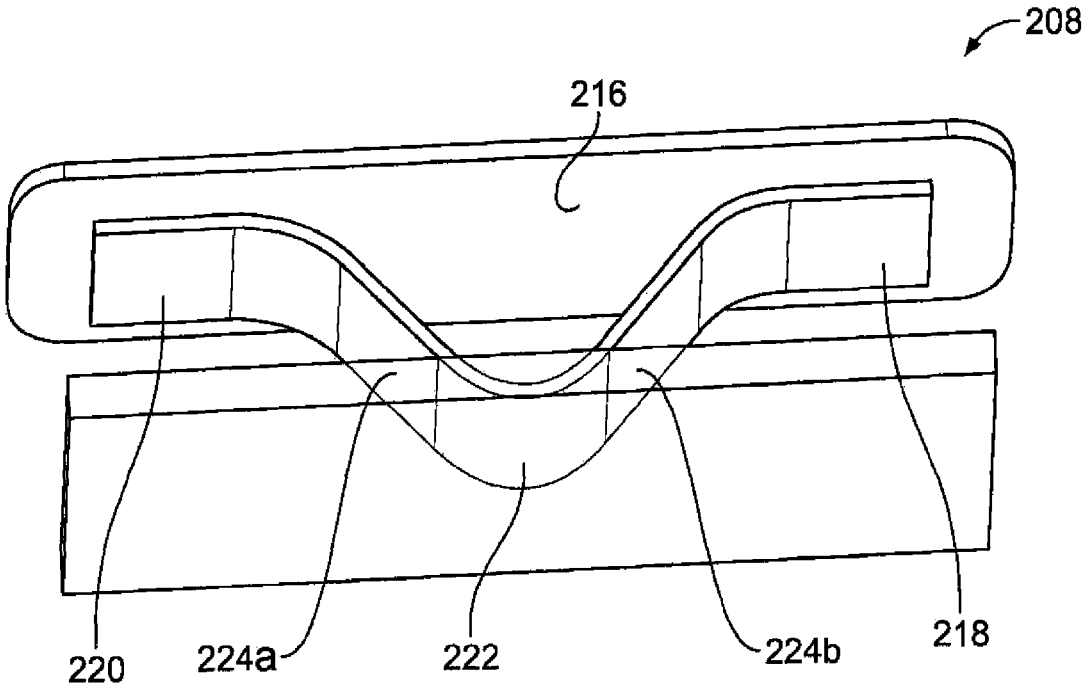
FIG. 7 illustrates a lower spacer of the tank car of FIG. 5.

An alternative arrangement of spacers is illustrated in FIGS. 5 through 7. As shown in FIG. 5, a tank car 200 having an inner tank 202 and an outer tank 204 has a plurality of upper spacers 206*a*-206*f* and a plurality of lower spacers 208*a*-208*e*. One side of the tank car 200 is shown in FIG. 5, and it should be understood that the other side has a symmetrical arrangement of spacers. The upper spacers 206*a*-208*f* are spaced apart along the length of the upper half of the tank car 200, and the lower spacers 208*a*-208*e* are spaced apart along the length of the lower half of the tank car 200. As illustrated, each side of the tank car preferably has six upper spacers 206*a*-206*f* and five lower spacers 208*a*-208*e*, but the number of upper and lower spacers will vary with the size of the tank.

One example of an upper spacer 206 is shown in FIG. 6. Each upper spacer 206 can be secured to the outer tank shell 204, such as, for example, being welded to the outer tank shell 204. An upper spacer 206 can be generally U-shaped, having two legs 210*a* and 210*b* that extend away from the outer tank shell 204 towards the inner tank shell 202, and a cross piece 212 that extends from one leg 210*a* to the other leg 210*b*, connecting the two legs. In some examples, the connection points 214*a* and 214*b* between the legs 210*a* and 210*b* and the cross piece 212 are squared or rounded. The upper spacers can be made of any suitable material, including, for example, A516-70 or TC128 Gr B steel. A572-50 steel can be used in place of A516-70 in any situation that is not pressure retaining. In at least one example, each leg 210*a* and 210*b* and the cross piece 212 of an upper spacer 206 can have a thickness from about ¼ of an inch to about 1 inch, including for example having a thickness of about ⅜ of an inch. Additionally, an upper spacer 206 can have any suitable height, measured from the end of the leg 210 that is secured to the outer tank shell 204 to the outer surface of the cross piece 212, and preferably has a height that spans the tank to tank clearance so that the cross piece 212 of the upper spacer 206 abuts the inner tank shell when the upper spacer 206 is installed in the tank car. Further, an upper spacer 206 can have any suitable width, measured from the outer edge of one leg 210 to the outer edge of the other leg 210, such as a width of from about 3 inches to about 5 inches, including for example about 3.5 inches.

One example of a lower spacer 208 is illustrated in FIG. 7. Each lower spacer 208 can be secured, such as by welding, to the inner tank shell 202, or preferably to a tank reinforcing pad 216 that is secured to the inner tank shell 202. As illustrated in FIG. 7, the lower spacer 208 is secured to the tank reinforcing pad 216 at a first end 218 and a second end 220. Between the first end 218 and the second end 220 of the lower spacer 208, the lower spacer curves outwardly, away from the inner tank shell 202 and the reinforcing pad 216, forming an apex 222 and two legs 224*a* and 224*b*. The lower spacers can be made of any suitable material, including, for example, A516-70 or TC 128 Gr B steel or A572-50 steel (for non-pressure retaining components). In at least one example, the lower spacer 208 can have a thickness from about ¼ of an inch to about 1 inch, including for example having a thickness of about ⅜ of an inch. The lower spacer can have any suitable length, measured from the outer edge of the first end 218 to the outer edge of the second end 220, including but not limited to a length of from about 8 inches to about 15 inches, including for example a length of about 12 inches. The lower spacer 208 can also have any suitable height, measured from the edge of the lower spacer secured to the inner tank shell 202 or the reinforcing pad 216 to the apex 222 of the lower spacer, and preferably has a height that spans the tank to tank clearance so that the apex 222 of the lower spacer 208 abuts the outer tank shell 204 when the lower spacer 208 is installed in the tank car.

Referring back to FIGS. 1-3, insulation 108 can surround the shell of the inner tank 104. Preferably, the insulation 108 substantially entirely surrounds the inner tank, 104, filling any area within the tank to tank clearance 106 that is not taken up by the spacers 110, the bottom support structure 112, and the dome 114. The insulation can be any suitable material, and can contain multiple layers. In one embodiment, the insulation includes a first insulation layer and a second insulation layer. The first insulation layer can be, for example, 4.5 pound cuft ceramic fiber, and can be about 2 inches thick. The second insulation layer can be, for example, ¾ pound cuft fiberglass, and can be about 2 inches thick. Insulation layers can vary with the clearance between tanks. As another example, more insulation may be compressed down to the four inches clearance so that a single layer of insulation is used.

Figure 8:
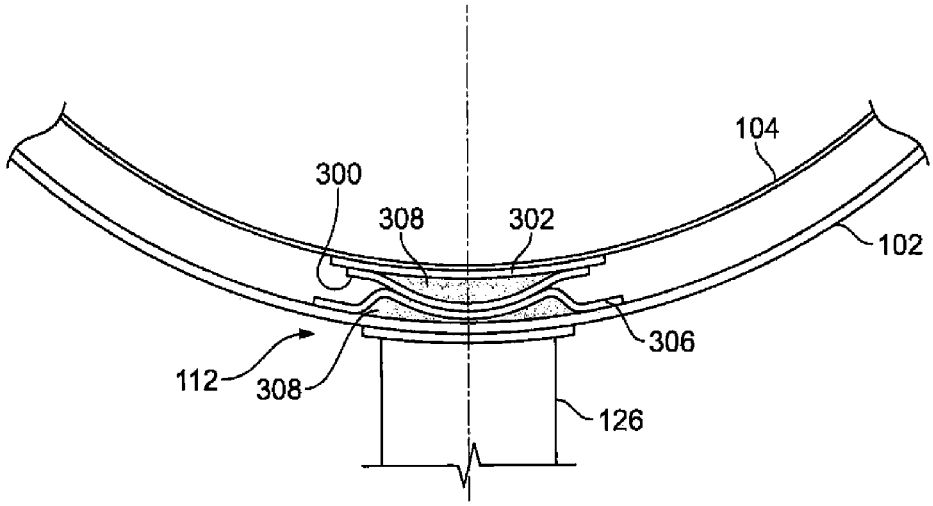
FIG. 8 is a cross-sectional view of one example of a lower support structure of the tank car of FIGS. 1 and 5.

Referring to FIGS. 1-3 and 8, the bottom support structure 112 can be made of any suitable materials, including, but not limited to A516-70 or TC128 Gr B steel. The bottom support structure 112 is preferably located between the inner tank 102 and outer tank 104 in the region of the bolsters 126. The bottom support structure 112 includes a curved inner tank support 300 that is secured, such as by welding, to the inner tank 104, or to an inner tank repad 302 as illustrated in FIG. 8. The inner tank repad 302 is secured, such as by welding, to the inner tank 104. The bottom support structure 112 also includes a tank cradle 306 that is secured, such as by welding, to the outer tank 102. The tank cradle 306 is shaped to receive the inner tank support 300. Support can thus be provided to the inner tank 104 by bottom support structure 112 when the inner tank support 300 rests on the tank cradle. While the inner tank support 300 and the tank cradle 306 are preferably in contact under normal operating and loading conditions, they are not mechanically connected. The inner tank support 300 can slide along the tank cradle 306 or lift off the cradle 306 under significant force loading conditions such as collision, derailment, and tank car rollover. In at least one embodiment, the bottom support structure 112 also includes foam 308, such as, for example DOW beta foam, to provide additional support. The foam 308 is located between the inner tank support 300 and the inner tank 104 or the inner tank repad 302, between the tank cradle 306 and the outer tank 102, or both. An alternative material for the bottom support includes A572-50 steel. In addition, a urethane foam may be used in place of DOW beta foam, but it would serve only a thermal function, not a structural one (which is acceptable).

Figure 9:
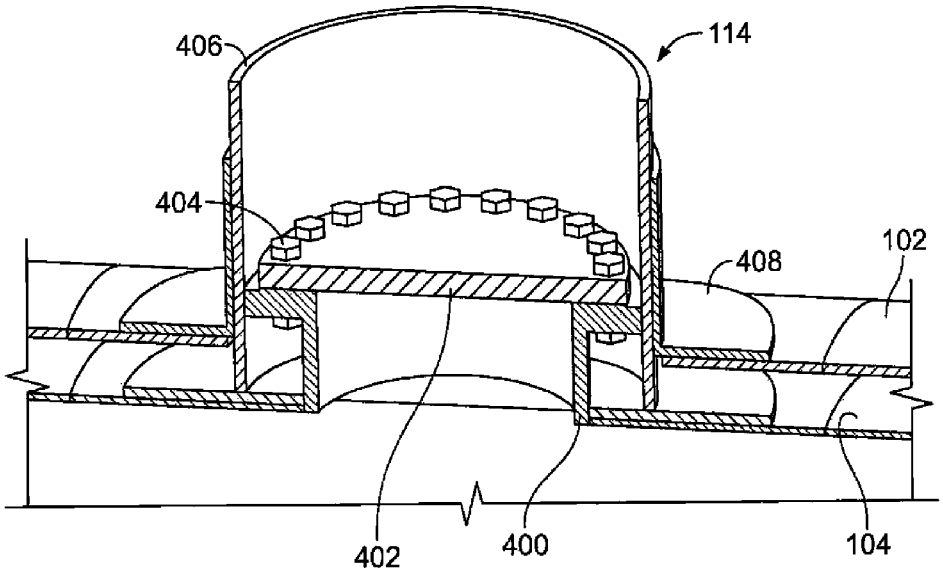
FIG. 9 illustrates one examples of a dome that can be used with the tank car of FIGS. 1 and 5.

FIG. 9 illustrates a cross-section of one example of a dome 114 that can be used with tank cars of the present technology. The dome 114 includes a nozzle 400, through which the commodity can be placed into and removed from the inner tank 104. When the tank car is in operation, a cover plate 402 can be used to cover and close the nozzle 400. The cover plate 402 is removably secured to the nozzle 400, such as being secured by a number of bolts 404. The dome 114 can include a sidewall 406, which can be circular, and which preferably extends above the nozzle 400 and cover plate 402. A circular reinforcing plate 408 can also be included, to provide additional structural support to the dome 114, including the sidewall 406.

The outer tank 102, insulation 108, spacers 110, and the inner tank 104 act as an energy absorbing system in the event of a derailment or other event that would possibly lead to a puncture, or other breach, of the inner tank 104. The energy absorbing system of the tank car 100 allows the inner tank 104 to move independently of the outer tank 102, which can absorb at least a significant amount of the force applied to the tank car 100 in an impact or derailment scenario, thus reducing the likelihood that the shell of the inner tank 104 will be breached.

Puncture Resistance

The tank car 100 preferably has a shell impact energy absorption of at least about 2.5 million foot-pounds at the tank centerline, and a head impact energy absorption of at least about 1.5 million foot-pounds at a point that is about 29 inches below the tank centerline. This can be about a 1.5 times increase in shell impact energy absorption, and a 1.4 times increase in head impact energy absorption, over current tank car designs, as shown in the Table 1 below.

TABLE 1

| Type of Tank Car | Shell Impact energy (ft-lbs) | Head Impact energy (ft-lbs) |
|---|---|---|
| Conventional 500 lb. Car | 1,261,000 | 782,000 |
| Interim 600 lb. Car | 1,742,000 | 1,100,000 |
| Subject Tank Car | 2,500,000 | 1,500,000 |

Example 1

Shell Puncture

Figure 10:
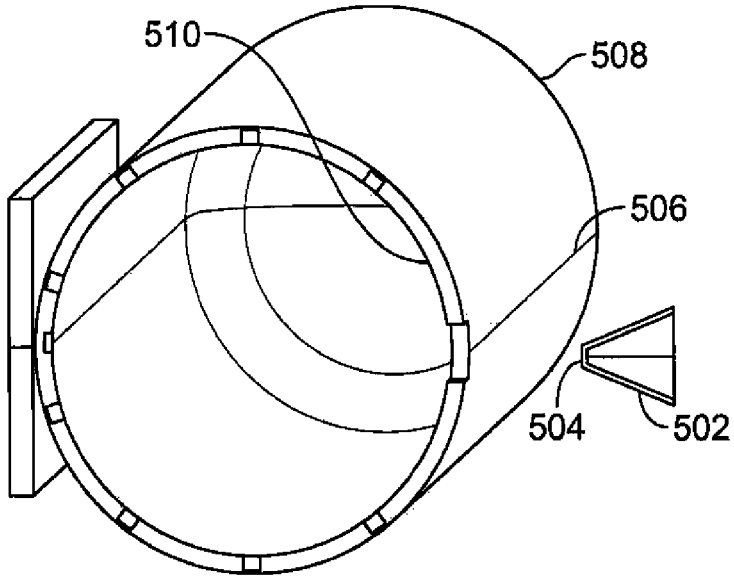
FIG. 10 illustrates a tank car of FIG. 5 undergoing shell impact energy absorption testing through finite element analysis, prior to the ram impacting the shell of the tank car.
Figure 11:
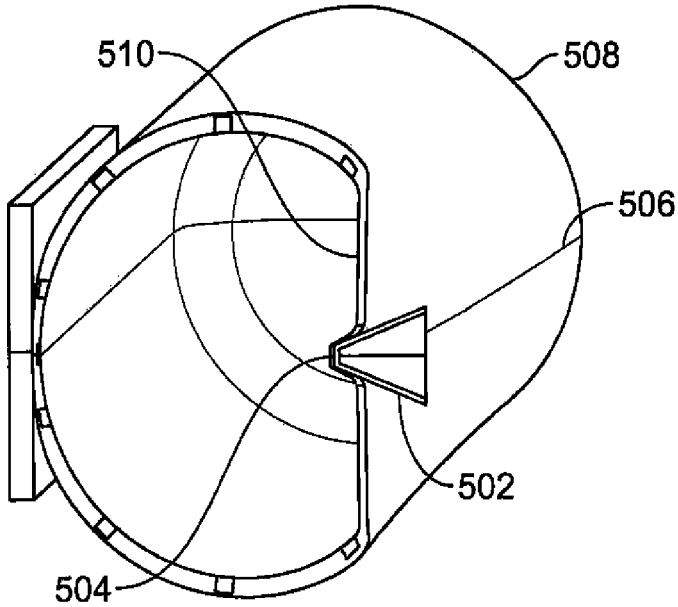
FIG. 11 illustrates a tank car of FIG. 5 undergoing shell impact energy absorption testing through finite element analysis, after the ram impacts the shell of the tank car.

With reference to Table 2, tank cars having an inner tank and an outer tank were analyzed, using finite element analysis, for shell impact energy absorption using a ram, as shown in FIGS. 10 and 11. The ram had a total weight of 286,000 pounds and a wedge shaped ram head 502 with a 6 inch by 6 inch impact face 504. As shown in FIGS. 10 and 11, the test was conducted by driving the ram into tank car at the centerline 506 of the tank outer shell 508. The impact energy, delivered by the ram was varied by changing the speed of the ram when it impacts the tank car, known as the ram impact speed. The shell impact energy absorption of a particular tank car is the maximum amount of impact energy that the shell of the tank car can absorb without puncturing.

The first and second tank car designs each had an inner tank shell 510 having a cylindrical length of about 472 inches and an inner diameter of about 100 inches, made of TC 128 GR B steel having a thickness of 0.4688 of an inch. The inner tank was pressurized at about 100 psi. The inner tank heads were 2:1 ellipsoidal heads made of TC 128 GR B steel, and the overall length of the inner tank car was about 522 inches as measured from the center point of the inner tank head at one end of the inner tank to the center point of the inner tank head at the opposite end of the inner tank.

The first tank car design had an inner and outer tank shell 508 made of TC 128 GR B steel having a thickness of 0.4688 inches, and a tank to tank standoff of about 4 inches. The ram impact speed was about 16.2 miles per hour (mph), delivering an impact energy of about 2.5 million foot-pounds. The impact energy delivered by the ram upon impact with the first tank car caused deformation of the outer tank shell and the inner tank shell, and also resulted in both shells being punctured. Calculations showed that the outer tank shell punctured at a ram displacement of about 29 inches and a peak force of about 855,000 pounds. The inner tank shell punctured rapidly after failure of the outer tank shell. The impact energy absorption at failure was calculated to be about 1.32 million foot-pounds. The results of the testing for the first tank car design are shown in row 7 of Table 2 below.

The second tank car design had an outer tank shell 508 made of TC 128 GR B steel having a thickness of 0.777 inches, and a tank to tank standoff of about 4 inches. The ram impact speed was about 16.2 miles per hour (mph), delivering an impact energy of about 2.5 million foot-pounds. As shown in FIG. 11, the impact energy delivered by the ram caused deformation of the outer tank shell 508 and the inner tank shell 510, but the outer jacket resisted the impact forces of the ram and neither outer tank shell 508 nor the inner tank shell 510 was punctured. The maximum ram displacement was about 42 inches, and the shell impact energy absorption was at least 2.5 million foot-pounds since the delivered impact energy of that amount was absorbed and dissipated by the tank deformation. The results of the testing for the second tank car design at this ram speed are shown in row 8 in Table 2 below.

The second tank car design was also tested at ram impact speeds of 17.7 mph, and 18.8 mph, and 20.0 mph, which delivered impact energies of 3.0 million ft-lbs, 2.6 million ft-lbs, and 2.6 million ft-lbs, respectively. The 3.0 million ft-lb impact energy was sufficient to initiate fractures in the 0.777 inches thick outer tank shell, but the outer tank shell was not fully penetrated and no fractures were initiated in the inner tank shell. Thus, the puncture threshold of the tank car is higher than the 3.0 million ft-lb impact energy. However, when the impact speed was further increased to 18.8 mph and 20.0 mph, puncture of the tank car resulted. Calculations determined that the puncture occurred at a an impact energy of approximately 2.6 million ft-lbs. Without being bound by any particular theory, it is believed that the puncture resulted due to additional dynamic effects that are introduced in the tank car response to impact at these higher speeds. Accordingly, the inertial effects at the higher speeds resulted in the impact forces exceeding the puncture threshold for the tank car at a lower displacement than was achieved when the impact speed was at the slightly reduced 17.7 mph. However, in each instance, the tank car still maintained a impact energy absorption above 2.5 million ft-lbs. The additional results of the testing for the second tank car design at these higher speeds are shown in rows 9-11 of Table 2 below.

The third tank car design had an outer tank shell 508 made of TC 128 GR B steel having a thickness of 0.7145 inches, and a tank to tank standoff of about 4 inches. The third tank car design had an inner tank shell 510 having a cylindrical length of about 472 inches and an inner diameter of about 100 inches, made of TC 128 GR B steel having a thickness of 0.5625 of an inch. The inner tank was pressurized at about 100 psi. The inner tank heads were 2:1 ellipsoidal heads made of TC 128 GR B steel, and the overall length of the inner tank car was about 522 inches as measured from the center point of the inner tank head at one end of the inner tank to the center point of the inner tank head at the opposite end of the inner tank. The third tank car design also tested at ram impact speed of 17.7 mph, which delivered impact energies of 3.0 million ft-lbs. The 3.0 million ft-lb impact energy was determined to be at the puncture threshold for the third tank car design. The results of the testing for the third tank car design are shown in row 12 of Table 2 below.

Testing was conducted on additional tank car designs as reported in Table 2 below. The dimensions and materials of the tank car designs, and the ram impact conditions, were the same as those above except for the dimensions noted in Table 2.

TABLE 2

| No. | Inner Tank Shell | Outer Tank Shell | Impact Speed | Internal Pressure (psi) | Puncture Force (lbs) | Puncture Energy (ft-lbs) |
|---|---|---|---|---|---|---|
| 1 | 0.5625 in TC128B | 0.119 in A1011 | 20.0 mph | 100 psi | 676,000 | 673,000 |
| 2 | 0.777 in TC128B | 0.119 in A1011 | 20.0 mph | 100 psi | 915,000 | 1,261,000 |
| 3 | 0.981 in TC128B | 0.119 in A1011 | 20.0 mph | 100 psi | 1,152,000 | 1,742,000 |
| 4 | 0.777 in TC128B | 0.375 in TC128B | 20.0 mph | 100 psi | 1,010,000 | 1,732,000 |
| 5 | 0.5625 in TC128B | 0.119 in A1011 | 20.0 mph | 100 psi | 686,000 | 675,000 |
| 6 | 0.777 in TC128B | 0.5625 in TC128B | 20.0 mph | 100 psi | 1,090,000 | 2,175,000 |
| 7 | 0.4688 in TC128B | 0.4688 in TC128B | 16.2 mph | 100 psi | 855,000 | 1,320,000 |
| 8 | 0.4688 in TC128B | 0.777 in TC128B | 16.2 mph | 100 psi | (1,100,000)[1] | (2,500,000)[1] |
| 9 | 0.4688 in TC128B | 0.777 in TC128B | 20.0 mph | 100 psi | 1,230,000 | 2,590,000 |
| 10 | 0.4688 in TC128B | 0.777 in TC128B | 17.7 mph | 100 psi | (1,190,000)[1] | (3,000,000)[1] |
| 11 | 0.4688 in TC128B | 0.777 in TC128B | 18.8 mph | 100 psi | 1,220,000 | 2,600,000 |
| 12 | 0.5625 in TC128B | 0.7145 in TC128B | 17.7 mph | 100 psi | 1,210,000 | 3,000,000 |

Note:
[1]Tank was not fully punctured at this impact velocity.

Example 2

Head Puncture

Figure 12:
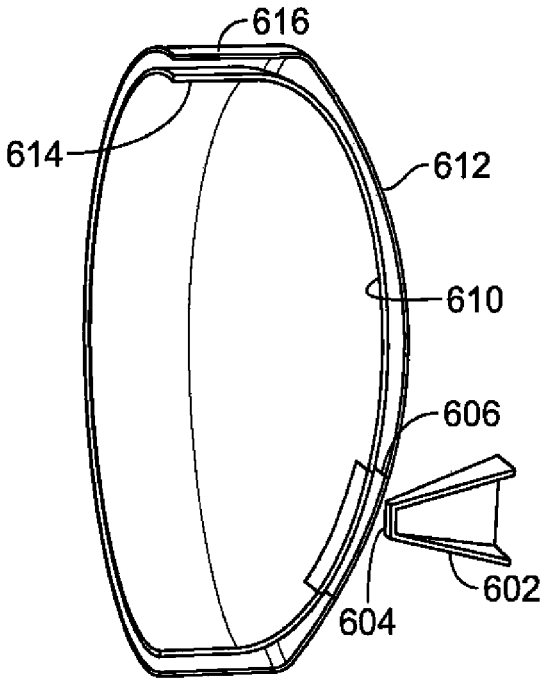
FIG. 12 illustrates a tank car of FIG. 5 undergoing head impact energy absorption testing through finite element analysis, prior to the ram impacting the head of the tank car.
Figure 13:
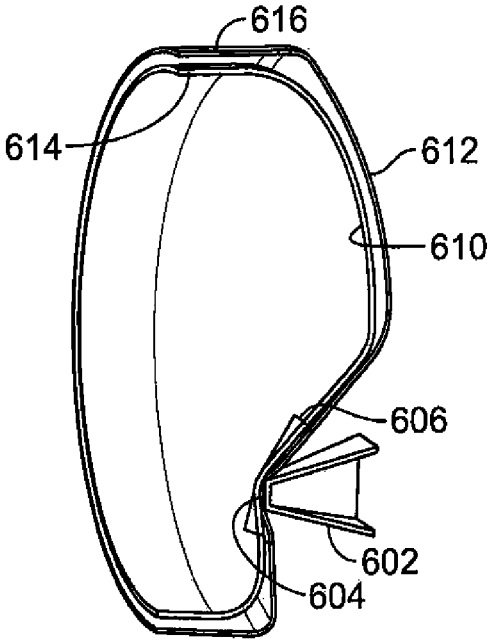
FIG. 13 illustrates a tank car of FIG. 5 undergoing head impact energy absorption testing through finite element analysis, after the ram impacts the head of the tank car.

Tank cars having an inner tank and an outer tank were analyzed for head impact energy absorption using a ram, as shown in FIGS. 12 and 13. The ram had a total weight of 286,000 pounds and a wedge shaped ram head 602 with a 6 inch by 6 inch impact face 604. As shown in FIGS. 12 and 13, the test was conducted by driving the ram into head tank car at a point 606 that is about 29 inches below the tank centerline. The impact energy, delivered by the ram was varied by changing the speed of the ram when it impacted the tank car, known as the ram impact speed. The head impact energy absorption of a particular tank car is the maximum amount of impact energy that the head of the tank car can absorb without puncturing.

Three test designs for the outer tank were evaluated, each having identical inner tank geometries, with a 0.879 inch thick TC128 Gr B steel inner tank head 610 and a 0.4688 inch thick TC128 Gr B steel inner tank shell 614. The inner tank head 610 for each tank car tested had a diameter that was nominally about 100 inches, and the inner tank was pressurized to an internal pressure of 100 psi. The geometry of the inner tank head 610 for each tank car was a 2:1 ellipsoid. The outer tank head 612 for each tank car had a 108 inch inner diameter and a dished geometry with a tank to tank clearance of 4 inches from the inner tank head 610.

The ram impact speed used for the initial head impact energy absorption analyses of all three outer tank test designs was 12.52 mph, which delivered an impact energy of 1.5 million ft-lbs. As shown in FIG. 13, the impact energy delivered by the ram caused at least deformation of the outer tank head 612 and the inner tank head 610 for each tested design, and also resulted in puncturing, some of the tested designs as described below.

The first outer tank design had a 0.500 inch thick TC 128 Gr B steel outer tank head 612, and a 0.375 inch thick TC128 Gr B steel outer tank shell 616. The outer tank head 612 was punctured at a ram displacement of approximately 18 inches and a peak ram force of approximately 1.06 million lbs. The inner tank head 610 was punctured at a ram displacement of approximately 22 inches and a ram force of 1.06 million lbs. The head puncture energy at puncture of the inner tank head 610 was calculated to be about 1.11 million ft-lbs. The results for the first design are listed in row 16 of Table 3 below.

The second outer tank design had a 0.879 inch thick TC128 Gr B steel outer tank head 612, and a 0.375 inch thick TC128 Gr B steel outer tank shell 616. The outer tank head 612 was partially penetrated late in the impact response, at a ram displacement of approximately 20 inches and a peak force of approximately 1.57 million lbs. However, the ram was stopped at a maximum displacement of approximately 21 inches, and the inner tank head 610 was not punctured. The entire impact energy of 1.5 million ft-lbs was absorbed and dissipated by this second design. The results for the second design are listed in row 17 of Table 3 below.

The third outer tank design had a 0.879 inch thick TC128 Gr B steel outer tank head 612, and a 0.777 inch thick TC128 Gr B steel outer tank shell 616 to be consistent with some of the outer tank shell designs of Example 1. The outer tank head 612 was partially penetrated late in the impact response, at a ram displacement approximately 19 inches and a peak force of approximately 1.59 million lbs. The ram was stopped at a maximum displacement of approximately 21 inches, and the inner tank head 610 was not punctured. The entire impact energy of 1.5 million ft-lbs was absorbed and dissipated by this third design. The results for the third design are listed in row 18 of Table 3 below.

To establish the maximum puncture energy that the third outer tank design can withstand, additional testing was performed at a higher ram impact speed of 14.5 mph, corresponding to an impact energy of 2.0 million ft-lbs. The higher speed impact was sufficient to puncture both the outer tank head and the inner tank head with a puncture energy of 1.86 million ft-lbs. The results for the third design at the higher speed are listed in row 19 of Table 3 below.

Testing was conducted on additional tank car designs as reported in Table 3 below. The dimensions and materials of the tank car designs, and the ram impact conditions, were the same as those above except for the dimensions noted in Table 3. The inner tank heads were all made of TC128 Gr B steel having a thickness indicated in Table 3 below, and the inner tank shells were all 0.4688 inch thick TC128 Gr B steel.

TABLE 3

| No. | Inner Tank Head | Outer Tank Head | Outer Tank Shell | Impact Speed | Puncture Force (lbs) | Puncture Energy (ft-lbs) |
|---|---|---|---|---|---|---|
| 1 | 1.1360" | 0.500" A572-50 | 11 gauge A1011 | 14 mph | 1,206,000 | 1,121,000 |
| 2 | 0.8281" | 0.500" A572-50 | 11 gauge A1011 | 10 mph | 966,000 | 916,000 |
| 3 | 0.8281" | 0.8281" TC128B | 11 gauge A1011 | 14 mph | 1,289,000 | 1,321,000 |
| 4 | 1.1360" | 0.500" A572-50 | 11 gauge A1011 | 11 mph | 1,229,000 | 1,110,000 |
| 5 | 0.6030" | 0.8281" TC128B | 0.375" TC128B | 11 mph | (1,240,000)[3] | (1,190,000)[3] |
| 6 | 0.6030" | 0.500" A572-50 | 11 gauge A1011 | 10 mph | 813,000 | 782,000 |
| 7 | 0.6030" | 0.8281" TC128B | 0.375" TC128B | 14 mph | 1,316,000 | 1,537,000 |
| 8 | 0.8281" | 0.8281" TC128B | 11 gauge A1011 | 14 mph | 1,311,000 | 1,482,000 |
| 9 | 0.8281" | 0.680" TC128B | 0.375" TC128B | 14 mph | 1,292,000 | 1,390,000 |
| 10 | 0.8281" | 11 gauge A1011 | 11 gauge A1011 | 10 mph | 813,000 | 610,000 |
| 11 | 0.8281" | 0.8281" TC128B | 11 gauge A1011 | 10 mph | 1,218,000 | 1,494,000 |
| 12 | 0.8281" | 0.680" TC128B | 0.375" TC128B | 14 mph | 1,195,000 | 1,252,000 |
| 13 | 0.8281" | 0.500" A572-50 | 11 gauge A1011 | 14 mph | 952,000 | 1,100,000 |
| 14 | 0.8281" | 0.680" TC128B | 11 gauge A1011 | 14 mph | 1,189,000 | 1,281,000 |
| 15 | 0.8281" | 0.8281" TC128B | 0.375" TC128B | 14 mph | 1,466,000 | 1,661,000 |
| 16 | 0.8790" | 0.5000" TC128B | 0.375" TC128B | 12.5 mph | 1,056,000 | 1,110,000 |
| 17 | 0.8790" | 0.8790" TC128B | 0.375" TC128B | 12.5 mph | (1,565,000)[3] | (1,500,000)[3] |
| 18 | 0.8790" | 0.8790" TC128B | 0.777" TC128B | 12.5 mph | (1,586,000)[3] | (1,500,000)[3] |
| 19 | 0.8790" | 0.8790" TC128B | 0.777" TC128B | 14.5 mph | 1,586,000 | 1,860,000 |

Example 3

A tank car of the present technology having a tank to tank clearance of about 4 inches was made having the following dimensions:

An inner tank shell having an inner diameter of 100.625 inches made of TC 128 GR B steel having a thickness of 15/32 of an inch.

An inner tank head made of TC 128 GR B steel having a thickness of 0.879 inches.

An outer tank shell having an inner diameter of 109.5625 inches made of TC 128 GR B steel having a thickness of 0.777 inches.

An outer tank head made of TC 128 GR B steel having a thickness of 0.879 inches.

The shell impact energy absorption of the tank car was determined to be about 3.0 million foot-pounds at the tank car centerline, and the head impact energy absorption was determined to be about 1.9 million foot-pounds at a point about 29 inches below the tank car centerline.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A tank car comprising:

an outer tank;

an inner tank enclosed within the outer tank, the inner tank being supported by a bottom support structure, where there is a tank to tank clearance defined between the inner tank and the outer tank;

spacers and insulation within the tank to tank clearance defined between the inner tank and the outer tank;

wherein the outer tank includes one or more openings and a spacer extends through each opening to abut the inner tank; and wherein the spacers each have a cover plate, at least two legs that extend away from the cover plate and a bottom connected to the at least two legs that contacts the inner tank when the spacer is inserted into an opening of the outer tank.

2. The tank car of claim 1, wherein the tank car has a shell impact energy absorption of the tank car that is at least 2.5 million foot-pounds and a head impact energy absorption of at least 1.5 million foot-pounds at a point approximately 29 inches below the tank car centerline.

3. The tank car of claim 1, the inner tank comprising an inner tank head and an inner tank shell, wherein the inner tank is made from TC 128 Gr B steel having a thickness at the inner tank head from about ¾ of an inch to about 1 inch and a thickness at the inner tank shell from about 7/16 of an inch to about 9/16 of an inch.

4. The tank car of claim 1, the outer tank comprising an outer tank head and an outer tank shell, wherein the outer tank is made from TC 128 Gr B steel having a thickness at the outer tank head from about ¾ of an inch to about 1 inch and a thickness at the outer tank shell from about ¾ of an inch to about 1 inch.

5. The tank car of claim 1, wherein the spacers comprise A516-70 or TC128 Gr B steel or A572-50 steel.

6. The tank car of claim 1, wherein the inner tank shifts within the outer tank under impact loading conditions and the insulation and spacers absorb energy of the impact loading conditions.

7. The tank car of claim 6, wherein the spacers absorb energy by crushing when the inner tank shifts under impact loading conditions.

8. A tank car comprising:

an outer tank;

an inner tank enclosed within the outer tank, the inner tank being supported by a bottom support structure, where there is a tank to tank clearance defined between the inner tank and the outer tank;

spacers and insulation within the tank to tank clearance defined between the inner tank and the outer tank;

wherein the spacers comprise a plurality of upper spacers spaced apart along an upper half of the tank car and a plurality of lower spacers spaced apart along a lower half of the tank car; and wherein the upper spacers have a U-shape, with two legs that extend away from the inner tank and a cross piece that connects the two legs and abuts the inner tank.

9. The tank car of claim 8, wherein the lower spacers include a first end and a second end, and a curve having an apex between the first end and the second end.

10. A tank car comprising:

an outer tank;

an inner tank enclosed within the outer tank, the inner tank being supported by a bottom support structure, where there is a tank to tank clearance defined between the inner tank and the outer tank;

spacers and insulation within the tank to tank clearance defined between the inner tank and the outer tank;

wherein the inner tank shifts within the outer tank under impact loading conditions and the insulation and spacers absorb energy of the impact loading conditions;

wherein the outer tank includes one or more openings and a spacer extends through each opening to abut the inner tank; and wherein the spacers each have a cover plate, at least two legs that extend away from the cover plate and a bottom connected to the at least two legs that contacts the inner tank when the spacer is inserted into an opening of the outer tank.

11. The tank car of claim 10, wherein the tank car has a shell impact energy absorption of the tank car that is at least 2.5 million foot-pounds and a head impact energy absorption of at least 1.5 million foot-pounds at a point approximately 29 inches below the tank car centerline.

12. The tank car of claim 10, the inner tank comprising an inner tank head and an inner tank shell, wherein the inner tank is made from TC 128 Gr B steel having a thickness at the inner tank head from about ¾ of an inch to about 1 inch and a thickness at the inner tank shell from about 7/16 of an inch to about 9/16 of an inch.

13. The tank car of claim 10, the outer tank comprising an outer tank head and an outer tank shell, wherein the outer tank is made from TC 128 Gr B steel having a thickness at the outer tank head from about ¾ of an inch to about 1 inch and a thickness at the outer tank shell from about ¾ of an inch to about 1 inch.

14. A tank car comprising:

an outer tank;

an inner tank enclosed within the outer tank, the inner tank being supported by a bottom support structure, where there is a tank to tank clearance defined between the inner tank and the outer tank;

spacers and insulation within the tank to tank clearance defined between the inner tank and the outer tank;

wherein the inner tank shifts within the outer tank under impact loading conditions and the insulation and spacers absorb energy of the impact loading conditions;

wherein the spacers comprise a plurality of upper spacers spaced apart along an upper half of the tank car and a plurality of lower spacers spaced apart along a lower half of the tank car; and wherein the upper spacers have a U-shape, with two legs that extend away from the inner tank and a cross piece that connects the two legs and abuts the inner tank.

15. The tank car of claim 14, wherein the lower spacers include a first end and a second end, and a curve having an apex between the first end and the second end.

* * * * *

UNITED STATES PATENT AND TRADEMARK OFFICE

CERTIFICATE OF CORRECTION

PATENT NO. : 8,833,268 B2
APPLICATION NO. : 12/966335
DATED : September 16, 2014
INVENTOR(S) : James Shirvinski et al.

It is certified that error appears in the above-identified patent and that said Letters Patent is hereby corrected as shown below:

Title Page,
Item [73], Assignee, replace "VA" with -LA-

Signed and Sealed this
Thirteenth Day of January, 2015

Michelle K. Lee

Michelle K. Lee
*Deputy Director of the United States Patent and Trademark Office*